US005665676A

United States Patent [19]

Nakamura et al.

[11] Patent Number: 5,665,676

[45] Date of Patent: Sep. 9, 1997

[54] PRINTING SHEET AND MANUFACTURING METHOD THEREFOR

[75] Inventors: Yoshinori Nakamura; Huy Sam, both of Miyagi; Yoshio Fujiwara, Tochigi; Toshikazu Nagura; Shigeo Hayasi, both of Kanagawa; Yukio Kusaka, Tochigi, all of Japan

[73] Assignees: Sony Corporation; New Oji Paper Co., Ltd., both of Tokyo, Japan

[21] Appl. No.: 515,647

[22] Filed: Aug. 16, 1995

Related U.S. Application Data

[63] Continuation of Ser. No. 257,093, Jun. 7, 1994, Pat. No. 5,470,817.

[30] Foreign Application Priority Data

Jun. 8, 1993 [JP] Japan ..... 5-164321

[51] Int. Cl.[6] ..... B41M 5/035; B41M 5/38

[52] U.S. Cl. ..... 503/227; 427/146; 428/195; 428/423.1; 428/447; 428/913; 428/914

[58] Field of Search ..... 8/471; 428/195, 428/423.1, 447, 913, 914; 503/227; 427/146

[56] References Cited

U.S. PATENT DOCUMENTS 4,962,080 10/1990 Watanabe ..... 503/227

5,187,144 2/1993 Shinohara et al. ..... 503/227

5,332,712 7/1994 Shinohara et al. ..... 503/227

FOREIGN PATENT DOCUMENTS 0440227 8/1991 European Pat. Off. ..... 503/227

*Primary Examiner*—Bruce H. Hess

*Attorney, Agent, or Firm*—Hill, Steadman & Simpson

[57] ABSTRACT

A printing sheet of the type which is used in a thermal transfer system, the printing sheet comprising a support and a dye receiving layer formed thereon, the dye receiving layer including a polymer containing isocyanate group, the polymer having polysiloxane unit and urea unit. The isocyanate group-containing polymer is selected from a reaction product between a multifunctional polyisocyanate compound and amino-modified silicone, or a reaction product between a multifunctional polyisocyanate compound and alcohol-modified silicone or carboxyl-modified silicone and an amine compound or water. According to the present invention, both the writing characteristic and anti-sebaceous characteristic on an image surface are improved simultaneously while basic characteristics such as printing sheet sensitivity, image preservative stability, and so on, are satisfied.

8 Claims, 1 Drawing Sheet

PRINTING SHEET AND MANUFACTURING METHOD THEREFOR

This is a continuation of application Ser. No. 08/257,093, filed Jun. 7, 1994, now U.S. Pat. No. 5,470,817.

BACKGROUND OF THE INVENTION

1. Field of the Invention

The present invention generally relates to printing papers or sheets suitable for use in thermal transfer systems, especially sublimation type thermal transfer systems and manufacturing methods therefor. More particularly, the present invention is directed to a printing paper or sheet which has excellent anti-sebaceous characteristic as well as excellent writing characteristic simultaneously, and a manufacturing method therefor.

2. Description of the Related Art

There is widely used a thermal transfer recording system in which an ink ribbon is heated through a thermal head or by laser or the like in accordance with image information to transfer a dye from the ink ribbon onto a printing sheet through thermal melting, thermal diffusion or sublimation to thereby form an image on the printing sheet. Particularly, in recent years, a sublimation type thermal transfer recording system receives a considerable attention, in which a thermal dispersion dye such as a sublimation dye or the like is used to form a full color image having continuous gradations. For example, an attempt to heat an ink ribbon selectively in accordance with an image signal of a video image to thereby form an image on a video printing sheet has been made.

As such a video printing sheet used is that which is obtained by forming a dye receiving layer on a sheet-like support made of polypropylene or the like. The dye receiving layer is a layer which receives a dye transferred thereto from the ink ribbon by heating and preserves an image formed from the dye. Examples of a resin heretofore used for constituting the aforementioned dye receiving layer include materials which can take dye well, for example, polyester, polycarbonate, polyvinyl chloride, vinyl chloride copolymer such as vinyl chloride-vinyl acetate copolymer, and thermoplastic resin such as polyurethane resin, polystyrene, AS resin, ABS resin, etc.

Further, in recent years, various attempts to improve sensitivity to make the formation of a sharp image possible and improve the weather resistance, light resistance and thermal stability of the resulting image to preserve the image stably have been made on the resin for constituting the dye receiving layer. For example, in order to improve the light resistance and weather resistance of the resulting image, use of cellulose ester mainly as the resin for constituting the dye receiving layer has been proposed (U.S. Pat. No. 5,278,130).

With the spread of thermal transfer recording system, not only the sensitivity, and the weather resistance, light resistance and thermal stability of the resulting image are required to be improved but also the following characteristics are required to be satisfied. That is, it is required to give a printing sheet such excellent anti-sebaceous characteristic that deposition of a dye on a human hand is prevented when the dye receiving layer having an image formed is rubbed with the hand, and it is required to give a printing sheet such excellent writing characteristic that characters written on the dye receiving layer with oil ink writing goods exhibit excellent fixing properties.

The aforementioned conventional printing sheet, however, has a problem in that anti-sebaceous characteristic and writing characteristic cannot be satisfied simultaneously. That is, in order to improve anti-sebaceous characteristic to prevent the deposition of a dye onto a human hand rubbing an image surface, it is required that a resin having high volatility to prevent the penetration of sebaceous oil into the dye receiving layer is used as the resin for constituting the dye receiving layer. On the contrary to the case of improvement of anti-sebaceous characteristic, in order to improve writing characteristic of the printing sheet to make it possible to write characteristics or the like on the printing sheet directly with an oil pen, it is required that a resin which has not high volatility but high lipophilic property so that a dye or dye-dispersed ink can penetrate into the dye receiving layer sufficiently is used as the resin for constituting the dye receiving layer. As described above, with respect to the resin for constituting the dye receiving layer, the property required in order to improve anti-sebaceous characteristic and the property required in order to improve writing characteristic are antinomic. It is therefore difficult to improve the two characteristics simultaneously. When, for example, an isocyanate cross-linking agent is contained in the dye receiving layer to perform a cross-linking reaction for the purpose of improving anti-sebaceous characteristic, oil ink can hardly penetrate into the dye receiving layer, resulting in lowering of writing characteristic.

OBJECTS AND SUMMARY OF THE INVENTION

It is an object of the present invention to provide an improved printing sheet and manufacturing method therefor in which the aforementioned shortcomings and disadvantages encountered with the related art can be eliminated.

More specifically, it is an object of the present invention to provide a printing sheet and manufactuing method therefor in which anti-sebaceous characteristic and writing characteristic are improved simultaneously while basic characteristics such as thermal transfer sensitivity, preservative stability, and so on, are satisfied.

According to an aspect of the present invention, there is provided a printing sheet of the type which is used in a thermal transfer recording system, the printing sheet comprising a support and a dye receiving layer formed thereon, the dye receiving layer including a polymer containing isocyanate group, the polymer having polysiloxane unit and urea unit.

According to another aspect of the present invention, there is provided a method for producing a printing sheet as defined above, the method comprising the steps of preparing an isocyanate group-containing polymer having polysiloxane unit and urea unit by making reaction between a multifunctional polyisocyanate compound and amino-modified silicone or by making reaction between a multifunctional polyisocyanate compound and alcohol-modified silicone or carboxylic acid-modified silicone and an amine compound or water, preparing a dye receiving layer forming composition containing the isocyanate group-containing polymer, and applying the dye receiving layer forming composition onto a support to form a dye receiving layer thereon.

The preceding and other objects, features, and advantages of the present invention will become apparent from the following detailed description of illustrative embodiments thereof when read in conjunction with the accompanying drawing.

DESCRIPTION OF THE PREFERRED EMBODIMENTS

Figure 1:
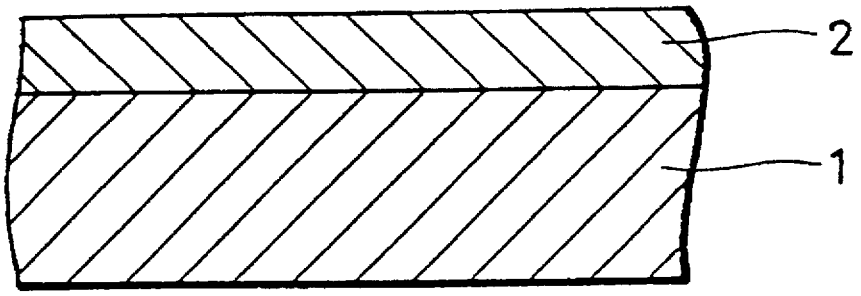
FIG. 1 is a schematic sectional view of a printing sheet according to the present invention.

An example of a printing sheet according to the present invention will now be described with reference to FIG. 1.

FIG. 1 is a sectional view of a printing sheet showing a preferred embodiment of the present invention. Referring to FIG. 1, the printing sheet according to the present invention has a structure in which a dye receiving layer 2 is laminated on a base sheet or support 1. The dye receiving layer 2 contains an isocyanate group-containing polymer.

The isocyanate group-containing polymer used in the present invention contains in molecule thereof at least one active isocyanate group, polysiloxane unit and urea unit. By using the aforementioned isocyanate group-containing polymer, both anti-sebaceous characteristic and writing characteristic can be improved simultaneously while basic characteristics such as thermal transfer sensitivity, preservative stability, and so on, are satisfied.

The molecular weight of the isocyanate group-containing polymer varies according to the purpose and condition of use of the printing sheet but it is generally selected to be preferably in a range of from 3,000 to 15,000.

The isocyanate group-containing polymer is preferably selected from a reaction product between a multifunctional polyisocyanate compound and amino-modified silicone, or a reaction product between a multifunctional polyisocyanate compound and alcohol-modified silicone or carboxyl-modified silicone and an amine compound or water.

As for the preparing method of these reaction products, they can be prepared by heating and mixing respective components in a solvent. In this case, the active isocyanate group in the isocyanate group-containing polymer is derived from a multifunctional polyisocyanate compound, the polysiloxane unit in the isocyanate group-containing polymer is derived from silicone system, and the urea unit in the isocyanate group-containing polymer is produced by reaction between the isocyanate group of a multifunctional polyisocyanate compound and the amino group of amino-modified silicone or the amino group of an amino compound, or by reaction between the isocyanate group of a polyisocyanate compound and water.

A compound containing two or more isocyanate groups in molecule thereof may be used as the multifunctional polyisocyanate compound. Preferably, a compound containing three or four isocyanate groups in one molecule thereof may be used as the multifunctional polyisocyanate compound. Specific examples of the multifunctional polyisocyanate compound used in the invention include adducts, biurets and isocyanurates of aromatic isocyanates, such as 2,4-tolylenediisocyanate (2,4-TDI), 2,6-TDI, diphenylmethane-4,4'-diisocyanate (MDI), hydrogenated MDI, 1,5-naphthalenediisocyanate, triphenylmethane triisocyanate, xylylenediisocyanate (XDI), hydrogenated XDI, metaxylylene diisocyanate (MXDI), 3-3'-dimethyl-4,4'-diphenylenediisocyanate (TODI), etc., aliphatic isocyanates, such as isophorone diisocyanate (IPDI), trimethylhexamethylene diisocyanate (TMDI), hexamethylene diisocyanate (HDI), dimethyldiisocyanate (DDI), etc., and so on, which are used as basic raw materials for polyurethane.

Preferably, the molecular weight of the multifunctional polyisocyanate compound is generally selected to be in a range of from about 500 to about 1,000.

Silicone having amino/hydroxy/carboxyl groups introduced into opposite ends thereof or silicone having an amino/hydroxy/carboxyl group introduced into one end thereof may be used as the amino-/alcohol-/carboxyl-modified silicone. Examples of the amino-modified silicone used in the invention include X-22-161A, X-22-161B, X-22-161C (which are of the type in which amino groups are introduced into opposite ends), KF-393, K-859, KF-860, K-861, KF-867 (which are of the type in which an amino group is introduced into one end) made by Shin-Etsu Chemical Industry Co., Ltd., and so on. Examples of the alcohol-modified silicone used in the invention include X-22-161AS, KF-6001, KF-6001, KF-6002, KF-6003 (which are of the type in which OH groups are introduced into opposite ends) made by Shin-Etsu Chemical Industry Co., Ltd., XF3868 (which is of the type in which an OH group is introduced into opposite ends) made by Toshiba Silicone Co., Ltd., and so on. Examples of the carboxyl-modified silicone used in the invention include X-22-162A, X-22-162C (which are of the type in which carboxyl groups are introduced into opposite ends) made by Shin-etsu Chemical Industry Co., Ltd., and so on.

The molecular weight of these silicones is selected to be preferably in a range of from 1,000 to 6,000, more preferably in a range of from 2,000 to 3,000.

A low-molecular compound having at least one amino group in molecule thereof may be used as the amino compound. Examples of the amino compound used in the invention include cyclohexylamine, hexamethylenediamine, and so on.

As described above, the dye receiving layer 2 has an isocyanate group-containing polymer contained therein. In addition, it is generally preferable that a thermoplastic or hardening resin as a film-forming component is contained in the dye receiving layer 2. A resin as used in a conventional dye receiving layer may be used as the resin. Examples of the thermoplastic resin used in the invention include polyester, polycarbonate, polyvinyl chloride, vinyl chloride copolymer such as vinyl chloride-vinyl acetate copolymer, vinyl chloride-acryl copolymer, etc., polyvinyl acetal, polyvinyl butyral, polyamide, polyvinyl acetate, polyurethane, polystyrene, AS resin, ABS resin, cellulose resin, cellulose ester resin, polyvinyl alcohol, acryl resin, and synthetic rubber such as SBR, NBR, etc. Examples of the hardening resin used in the invention include thermosetting resins, ultraviolet-setting resins and electron-setting resins, such as phenol resin, unsaturated polyester resin, melamine resin, urea resin, etc. These resin materials may be used singly or in combination. Among these resin materials, polyester and/or cellulose ester may be used preferably from the point of view of improvement in sensitivity, image preservation, writing characteristic and anti-sebaceous characteristic.

In the case where the dye receiving layer 2 contains a resin as a film-forming component, if the containing ratio of the isocyanate group-containing polymer in the dye receiving layer 2 is too low the effect of improvement in anti-sebaceous characteristic is insufficient. If the containing ratio is too high, transfer sensitivity is lowered. Accordingly, the polymer containing ratio in the dye receiving layer 2 is selected to be preferably in a range of from 0.5 parts by weight to 30 parts by weight per 100 parts by weight of the resin as a film-forming component.

Further, the dye receiving layer 2 may contain various additives which are phase-solubility with the isocyanate group-containing polymer and the resin component. For example, various kinds of esters, ethers, hydrocarbon compounds, and so on, may be contained as additives (sensitizers) which are dissolved so as to be phase-soluble with the thermoplastic resin to form an amorphous state to thereby accelerate the dispersion (dyeing property) of a dye, make the dye penetrate into the dye receiving layer and improve light resistance and heat resistance.

As the esters, ethers and hydrocarbon compounds, there may be used liquid or solid compounds having a melting point of from about −50° to about 150° C. Examples of the esters include: phthalic esters such as dimethyl phthalate, diethyl phthalate, dioctyl phthalate, dicyclohexyl phthalate, diphenyl phthalate, etc.; isophthalic esters such as dicyclohexyl isophthalate, etc.; aliphatic dibasic esters such as dioctyl adipate, dioctyl sebacate, dicyclohexyl azelate, etc.; phosphoric esters such as triphenyl phosphate, tricyclohexyl phosphate, triethyl phosphate, etc.; higher fatty acid esters such as dimethyl isophthalate, diethyl isophthalate, butyl stearate, cyclohexyl laurate, cyclohexyl laurate, etc.; silicic esters; boric esters; and so on. Examples of the ethers include diphenyl ether, dicyclohexyl ether, p-ethoxy methyl benzoate, and so on. Examples of the hydrocarbon compounds include: phenols such as camphor, low-molecular polystyrene, p-phenyl phenol, o-phenyl phenol, etc.; N-ethyltoluene sulfanilamide; and so on.

Further, the dye receiving layer in the printing sheet according to the present invention may also contain a fluorescent whitening agent and a white pigment to improve the whiteness of the dye receiving layer to thereby improve the sharpness of the resulting image, give good writing characteristic to a surface of the printing sheet and prevent the re-transfer of the resulting image. As the fluorescent whitening agent and the white pigment, there may be used available materials on the market. For example, UVITEX OB made by Chiba Geigy Co., Ltd. may be used as the fluorescent whitening agent.

Further, the dye receiving layer may contain an antistatic agent to prevent the generation of static electricity therein in a printer at the time of the running thereof. As the antistatic agent, there may be used various kinds of surface active agents such as cationic surface active agents (e.g., quaternary ammonium slats, polyamine derivatives, etc.), anionic surface active agents (e.g., alkylbenzene sulfonate, alkyl sodium sulfate, etc.), amphoteric surface active agents, nonionic surface active agents, and so on. These antistatic agents may be contained in the inside of the dye receiving layer or may be applied to the surface of the dye receiving layer by coating or the like.

In addition, the dye receiving layer may contain a plasticizer, an ultraviolet-ray absorbing agent, an antioxidant, and so on, suitably.

In the production of the printing sheet according to the present invention, it is important that an isocyanate group-containing polymer is prepared before a dye receiving layer composition is prepared by mixing the polymer with a film-forming resin as occasion demands. If there is no preparation of an isocyanate group-containing polymer before a dye receiving layer composition is prepared by mixing a multifunctional polyisocyanate compound as the raw material of the polymer and amino-modified silicone with a film-forming resin, the dye receiving layer formed from the composition thereof cannot fulfill the effect of the present invention.

Accordingly, the printing sheet according to the present invention is produced by the steps of: preparing an isocyanate group-containing polymer having polysiloxane unit and urea unit by reaction of a multifunctional polyisocyanate compound and amino-modified silicone, by reaction of a multifunctional polyisocyanate compound and alcohol-modified silicone or by reaction of carboxylic acid modified silicone an amine compound or water; preparing a dye receiving layer forming composition containing the isocyanate group-containing polymer thus prepared; and applying the dye receiving layer forming composition onto a support by an ordinary method to form a dye receiving layer thereon.

The printing sheet according to the present invention is characterized in that the printing sheet has the aforementioned dye receiving layer. That is, the printing sheet according to the present invention may be configured in the same manner as a conventional printing sheet except the aforementioned characteristic. For example, the material of the support 1 may be selected from papers such as wood free paper, coated paper, etc., various kinds of plastic sheets, composite laminate sheets thereof, and so on, as used in the conventional printing sheet. If necessary, a lubricating layer or the like may be provided on a surface opposite to the dye receiving layer of the support 1. As for the method of forming an image on the printing sheet, a conventional method can be applied to the present invention. Further, the kind of the dye to be used is not limited specifically.

Because the dye receiving layer in the printing sheet according to the present invention contains an isocyanate group-containing polymer having polysiloxane unit and urea unit, both anti-sebaceous characteristic and writing characteristic may be improved simultaneously while basic characteristics such as thermal transfer sensitivity, preservative stability, and so on, are satisfied.

EXAMPLES

The present invention will be described specifically on the basis of the following examples.

In the following examples and comparative examples, a material obtained by sticking an inorganic pigment-containing polyolefin multilayer film (YUPO FPG60 made by Oji Yuka Synthetic Paper Co., Ltd.) of 60 μm thickness to a surface of a 38 μm-thick polyethylene terephthalate film with a polyester system adhesive agent by dry lamination was used as a support of a printing sheet. In the examples, a dye receiving layer was formed on the inorganic pigment-containing polyolefin multilayer film side.

In the following examples and comparative examples, "parts" means parts by weight.

Example 1

Five parts of amino-modified silicone (X-22-161B made by Shin-etsu Chemical Industry Co., Ltd.) and five parts of multifunctional polyisocyanate (TAKENATE D110N made by Takeda Chemical Industries, Ltd.) were mixed as a 20% solution in a toluene/methyl ethyl ketone (5:1) mixture solvent. This solution was stirred at 80° C. for 24 hours to react the silicone with the polyisocyanate thus to prepare an isocyanate group-containing polymer solution.

Then, 30 parts of the isocyanate group-containing polymer solution thus prepared was mixed with 100 parts of a polyester resin (BYLON 200 made by Toyobo Co., Ltd.). Further, toluene was added to the resulting mixture thus to prepare a 20% solution (dye receiving layer forming composition solution).

The dye receiving layer forming composition solution thus prepared was coated onto the printing sheet support at the rate of 5 g (solid component)/$m^2$ by die coating and was dried to form a dye receiving layer thus to produce a printing sheet.

(Evaluation)

The optical density, writing characteristic, anti-sebaceous characteristic and light-resisting preservative characteristic of an image formed by applying all-over black printing to the thus produced printing sheet through a sublimation color video printer (CVP-G7 made by Sony Corporation) using a sublimation transfer ink ribbon (VPM-30 made by Sony Corporation) were evaluated as follows. Results of the evaluation were as shown in Table 1.

(i) Optical Density

The optical density was measured by using a Macbeth densitometer RD-914.

(ii) Writing Characteristic

Writing was performed on the printing sheet surface with an oil pen (TOMBOW F-1 made by Tombow Pencil Co. Ltd.), and then the state of writing was observed by eyes. The evaluation of the state of writing was classified into three groups, good "O", slightly poor "Δ" and poor "x".

(iii) Anti-sebaceous Characteristic

Corn oil was applied onto a printing surface of the printing sheet and then the printing sheet was left for 30 minutes. The state of a portion where oil was deposited on the printing surface of the printing sheet and the state of a portion where oil was not deposited were observed by eyes. The evaluation was classified into three groups, case where the dye from the dye receiving layer was not transferred to the corn oil "O", case where the dye was slightly transferred to the corn oil "Δ", and case where the dye was considerably transferred to the corn oil "x".

(iv) Light-resisting Preservative Characteristic

A light resistance test was performed on the overall black printed sheet in the conditions of 63° C., 50% RH and 48 hours by using an Atlas fade meter, and then the degree of lowering of the density of the image was observed by eyes. The evaluation was classified into three groups, case where there was no observation of lowering of the density "O", case where slight lowering of the density was observed "Δ", and case where considerable lowering of the density was observed

| | Optical Density | Anti-sebaceous character | Writing Character | Light-resisting Preservative Character |
|---|---|---|---|---|
| Example 1 | 2.20 | O | O | O |
| Example 2 | 2.13 | O | O | O |
| Example 3 | 2.08 | O | O | O |
| Comparative Example 1 | 2.23 | Δ | O | X |
| Comparative Example 2 | 2.15 | Δ | O | X |
| Comparative Example 3 | 1.98 | X | O | O |

It was apparent from Table 1 that the printing sheet in this example was excellent in the optical density of the image, anti-sebaceous characteristic, light-resisting preservative characteristic and writing characteristic.

Example 2

Five parts of alcohol-modified silicone (X-22-4015 made by Shin-Etsu Chemical Industry Co., Ltd. ), five parts of multifunctional polyisocyanate (CORONATE HL made by Nippon Polyurethane Industry Co., Ltd. ) and 0.1 parts of water were mixed as a 20% solution in a toluene/methyl ethyl ketone (5:1) mixture solvent. This solution was stirred at 80° C. for 24 hours to react the silicone, the polyisocyanate and water thus to prepare an isocyanate group-containing polymer solution.

A dye receiving layer forming composition was prepared in the same manner as in Example 1 except that the isocyanate group-containing polymer solution in Example 1 was replaced by the isocyanate group-containing polymer solution thus prepared. Further, a printing sheet was produced.

The printing sheet thus produced was evaluated in the same manner as in Example 1. Results of the evaluation was as shown in Table 1. It was apparent from Table 1 that the printing sheet in this example was excellent in the optical density of the image, anti-sebaceous characteristic, light-resisting preservative characteristic and writing characteristic.

Example 3

Five parts of alcohol-modified silicone (X-22-4015 made by Shin-Etsu Chemical Industry Co., Ltd.), five parts of multifunctional polyisocyanate (TAKENATE D110N made by Takeda Chemical Industries, Ltd.) and three parts of hexamethylene diamine were mixed as a 20% solution in a toluene/methyl ethyl ketone (5:1) mixture solvent. This solution was stirred at 80° C. for 24 hours to react the silicone, the polyisocyanate and the hexamethylene diamine thus to prepare an isocyanate group-containing polymer solution.

A dye receiving layer forming composition was prepared in the same manner as in Example 1 except that the isocyanate group-containing polymer solution in Example 1 was replaced by the isocyanate group-containing polymer solution thus prepared and that the polyester resin in Example 1 was replaced by a cellulose acetate butyrate resin (CAB-272-3 made by Eastman Kodak Co.). Further, a printing sheet was produced.

The printing sheet thus produced was evaluated in the same manner as in Example 1. Results of the evaluation was as shown in Table 1. It was apparent from Table 1 that the printing sheet in this example was excellent in the optical density of the image, anti-sebaceous characteristic, light-resisting preservative characteristic and writing characteristic.

Comparative Example 1

One hundred parts of a polyester resin (BYLON 200 made by Toyobo Co., Ltd.), five parts of amino-modified silicone (X-22-161B made by Shin-Etsu Chemical Industry Co., Ltd.) and five parts of multifunctional polyisocyanate (TAKENATE D110N made by Takeda Chemical Industries, Ltd.) were dissolved at the same time in a toluene/methyl ethyl ketone (5:1) mixture solvent to prepare a 20% solution (dye receiving layer forming composition solution) thereof.

A printing sheet was produced in the same manner as in Example 1 except that the dye receiving layer forming composition solution thus prepared was used. The printing sheet thus produced was evaluated in the same manner as in Example 1. Results of the evaluation was as shown in Table 1.

It was apparent from Table 1 that the printing sheet in this comparative example was deteriorated in anti-sebaceous characteristic and was remarkably deteriorated in light-resisting preservative characteristic as compared with the printing sheets of Examples.

Comparative Example 2

One hundred parts of a polyester resin (BYLON 200 made by Toyobo Co., Ltd.), five parts of alcohol-modified silicone (X-22-4015 made by Shin-Etsu Chemical Industry Co., Ltd.) and five parts of multifunctional polyisocyanate (CORONATE HL made by Nippon Polyurethane Industry Co., Ltd.) were dissolved at the same time in a toluene/methyl ethyl ketone (5:1) mixture solvent to prepare a 20% solution (dye receiving layer forming composition solution) thereof.

A printing sheet was produced in the same manner as in Example 1 except that the dye receiving layer forming composition solution thus prepared was used. The printing sheet thus produced was evaluated in the same manner as in Example 1. Results of the evaluation was as shown in Table 1.

It was apparent from Table 1 that the printing sheet in this comparative example was deteriorated in anti-sebaceous characteristic and was remarkably deteriorated in light-resisting preservative characteristic as compared with the printing sheets of Examples.

Comparative Example 3

One hundred parts of a cellulose acetate butyrate resin (CAB-272-3 made by Eastman Kodak Co.), five parts of amino-modified silicone (X-22-161B made by Shin-Etsu Chemical Industry Co., Ltd.) and five parts of multifunctional polyisocyanate (TAKENATE D110N made by Takeda Chemical Industries, Ltd.) were dissolved at the same time in a toluene/methyl ethyl ketone (5:1) mixture solvent to prepare a 20% solution (dye receiving layer forming composition solution) thereof.

A printing sheet was produced in the same manner as in Example 1 except that the dye receiving layer forming composition solution thus prepared was used. The printing sheet thus produced was evaluated in the same manner as in Example 1. Results of the evaluation was as shown in Table 1.

It was apparent from Table 1 that the printing sheet in this comparative example was remarkably deteriorated in anti-sebaceous characteristic as compared with the printing sheets of Examples.

As set out above, according to the printing sheet of the present invention, both writing characteristic and anti-sebaceous characteristic can be improved simultaneously while basic characteristics such as sensitivity, preservative stability, and so on, are satisfied.

Having described the preferred embodiments of the present invention with reference to the accompanying drawing, it is to be understood that the present invention is not limited to those precise embodiments and that various changes and modifications thereof could be effected by one skilled in the art without departing from the spirit or scope of the novel concepts of the invnetion as defined in the appended claims.

What is claimed is:

1. A printing sheet for use in a thermal transfer system including a support having a dye receiving layer disposed thereon, said dye receiving layer consisting essentially of:

(A) a film forming resin selected from the group consisting of: thermoplastic resins, thermosetting resins, ultraviolet setting resins, electron setting resins and mixtures of any of the foregoing resins;

(B) from about 0.5 to about 30 parts by weight per 100 parts by weight of said film forming resin component (A) of a previously prepared isocyanate group-containing polymer produced by reaction of:

(a) a multifunctional polyisocyanate with (b) a co-reactant selected from (i) a combination of a carboxy-terminated polysiloxane and a diamine;

(ii) a combination of a hydroxy-terminated polysiloxane and a diamine; or (iii) a combination of a carboxy-terminated polysiloxane and water, said isocyanate group-containing polymer having a molecular weight of from about 3,000 to about 15,000; and (C) optionally including an additive selected from the group consisting of: dye dispersing agents, fluorescent whitening agents, white pigments, antistatic agents, plasticizers, UV absorbers and antioxidants.

2. A printing sheet as defined in claim 1, wherein the multifunctional polyisocyanate is selected from aromatic and aliphatic polyisocyanates containing two or more isocyanate groups per molecule.

3. A printing sheet as defined in claim 1, wherein the multifunctional polyisocyanate component (a) is selected from the group consisting of 2,4-tolylenediisocyanate, 2,6-tolylenediisocyanate, diphenylmethane-4,4'-diisocyanate, hydrogenated diphenylmethane-4,4'-diisocyanate, 1,5-napthalenediisocyanate, triphenylmethane triisocyanate, xylylenediisocyanate, hydrogenated xylylenediisocyanate, metaxylylenediisocyanate, 3,3'-dimethyl-4,4'-diphenylenediisocyanate and adducts, biurets and isocyanurates any of the foregoing aromatic isocyanates, isophoronediisocyanate, trimethylhexamethylenediisocyanate, hexamethylenediisocyanate and dimethyldiisocyanate.

4. A printing sheet as defined in claim 1, wherein each of the polysiloxanes of components (b)(i), (b)(ii), and (b) (iii) has a molecular weight of from about 1,000 to about 6,000.

5. A printing sheet as defined in claim 1, wherein the isocyanate group-containing polymer is a reaction product of (a) in multifunctional polyisocyanate and (b)(i) a combination of a carboxy-terminated polysiloxane and a diamine.

6. A printing sheet as defined in claim 1, wherein the isocyanate group-containing polymer is a reaction product of (a) a multifunctional polyisocyanate and (b)(ii) a combination of a hydroxy-terminated polysiloxane and a diamine.

7. A printing sheet as defined in claim 1, wherein the isocyanate group-containing polymer is a reaction product of (1) a multifunctional polyisocyanate and (b)(iii) a combination of a carboxyl-terminated polysiloxane and water.

8. A method for producing a printing sheet as defined in claim 1, comprising the steps of:

preparing an isocyanate group-containing polymer having polysiloxane unit and urea unit by making reaction between a multifunctional polyiocyanate compound and amino-modified silicone or by making reaction between a multifunctional polyisocyanate compound and alcohol-modified silicone or carboxyl-modified silicone and an amine compound or water;

preparing a dye receiving layer forming composition containing said isocyanate group-containing polymer; and applying said dye receiving layer forming composition onto a support to form a dye receiving layer thereon.

* * * * *